US011028330B2

(12) United States Patent
Odile et al.

(10) Patent No.: US 11,028,330 B2
(45) Date of Patent: Jun. 8, 2021

(54) HYDROTREATMENT OR HYDROCONVERSION PROCESS WITH A STRIPPER AND A LOW PRESSURE SEPARATOR DRUM IN THE FRACTIONATION SECTION

(71) Applicant: AXENS, Rueil Malmaison (FR)

(72) Inventors: Lajeunesse Odile, Rueil-Malmaison (FR); Pierre-Yves Alspektor, St. Cloud (FR); Paris Packeu, Niort (FR); Nicolas Pupat, Houilles (FR)

(73) Assignee: AXENS, Rueil-Malmaison (FR)

( * ) Notice: Subject to any disclaimer, the term of this patent is extended or adjusted under 35 U.S.C. 154(b) by 245 days.

(21) Appl. No.: 15/388,880

(22) Filed: Dec. 22, 2016

(65) Prior Publication Data

US 2017/0183574 A1 Jun. 29, 2017

(30) Foreign Application Priority Data

Dec. 23, 2015 (FR) ..... 15/63.173

(51) Int. Cl.

| | |
|---|---|
| ***C10G 67/00*** | (2006.01) |
| ***C10G 67/02*** | (2006.01) |
| ***C10G 49/22*** | (2006.01) |
| ***C10G 47/00*** | (2006.01) |
| ***C10G 45/00*** | (2006.01) |

(52) U.S. Cl.

CPC ..... *C10G 67/02* (2013.01); *C10G 45/00* (2013.01); *C10G 47/00* (2013.01); *C10G 49/22* (2013.01); *C10G 2300/107* (2013.01); *C10G 2300/1022* (2013.01); *C10G 2300/1048* (2013.01); *C10G 2300/1074* (2013.01); *C10G 2300/1077* (2013.01); *C10G 2300/207* (2013.01)

(58) Field of Classification Search

CPC ..... C10G 7/00; C10G 45/00; C10G 45/02; C10G 45/32; C10G 45/44; C10G 45/58; C10G 47/00; C10G 49/00; C10G 49/002; C10G 49/22; C10G 67/02; C10G 2300/207; C10G 2300/1022; C10G 2300/1048; C10G 2300/107; C10G 2300/1074; C10G 2300/1077

See application file for complete search history.

(56) References Cited

U.S. PATENT DOCUMENTS

| | | | | |
|---|---|---|---|---|
| 3,371,029 | A * | 2/1968 | Weiland | C10G 5/00 208/102 |
| 3,733,260 | A * | 5/1973 | Davies et al. | C10G 49/22 208/212 |
| 7,959,794 | B2 | 6/2011 | Galeazzi et al. | |
| 2005/0035028 | A1 | 2/2005 | Galeazzi et al. | |
| 2010/0326882 | A1* | 12/2010 | McGehee | C08L 95/00 208/22 |

(Continued)

OTHER PUBLICATIONS

Search Report for related French patent application No. 15/63.173 dated Sep. 6, 2016.

*Primary Examiner* — Prem C Singh
*Assistant Examiner* — Brandi M Doyle
(74) *Attorney, Agent, or Firm* — Millen, White, Zelano and Branigan, P.C.

(57) ABSTRACT

A facility and a process for hydrotreatment or hydroconversion, in which a fractionation section comprises a stripper which operates on the overhead fraction obtained from a low pressure separator drum.

11 Claims, 2 Drawing Sheets

(56) References Cited

U.S. PATENT DOCUMENTS

| | | | | |
|---|---|---|---|---|
| 2013/0001127 | A1* | 1/2013 | Aubry | C10G 45/44<br>208/18 |
| 2016/0348013 | A1* | 12/2016 | Ladkat | C10G 67/02 |
| 2017/0183581 | A1* | 6/2017 | Ladkat | C10G 67/06 |
| 2018/0044600 | A1* | 2/2018 | Zink | B01J 38/12 |

* cited by examiner

HYDROTREATMENT OR HYDROCONVERSION PROCESS WITH A STRIPPER AND A LOW PRESSURE SEPARATOR DRUM IN THE FRACTIONATION SECTION

CONTEXT OF THE INVENTION

The invention relates to the field of hydrotreatment or hydroconversion processes. Conventional processes for the hydrotreatment or hydroconversion of gas oils, vacuum distillates, atmospheric or vacuum residues or effluents from the Fischer-Tropsch unit generally include a section for fractionation of the effluent from the reaction section which principally has two aims, namely the elimination of $H_2S$ and light compounds, and principal fractionation of the products from the unit. Accomplishing these two aims requires the consumption of energy and represents a large amount of investment and high operating costs, both in absolute terms and with respect to the process as a whole.

PRIOR ART

U.S. Pat. No. 3,733,260 describes a process for the hydrodesulphurization of gas oils, comprising a hydrodesulphurization reaction section, a separation of the effluent from this section into a gaseous fraction and a first liquid fraction at high temperature and high pressure, a partial condensation of said vapour phase into a gaseous fraction essentially comprising hydrogen, and a second liquid fraction, stripping the $H_2S$ and the light hydrocarbons from the first and second liquid fraction using pre-treated hydrogen, a separation of the stripped hydrocarbons into a naphtha and a gas oil and recycling said naphtha to the condensation step.

This configuration requires the generation of a reflux to carry out the stripping, and suffers from the disadvantage of dissipating some of the energy contained in the effluent from the reaction section in the head air condenser of the stripper. In addition, since the optimal temperature required for the supply to the stripper is lower than the minimum temperature required for the downstream separation, this means that the feed for this separation has to be heated.

U.S. Pat. No. 3,371,029 describes a process for separating hydrogen-containing effluents from a hydrocarbon conversion reactor in which there is no stripping of $H_2S$ and hydrocarbons upstream of the principal hydrocarbon separation into a naphtha, a gas oil and heavier compounds.

This latter configuration suffers from the disadvantage that, following elimination of $H_2S$, the acid gases which are inevitably obtained from the principal separation, operated at a pressure close to atmospheric pressure, have to be compressed before being returned to a fuel gas system of a refinery.

The invention corrects these disadvantages by minimizing or even dispensing with the overhead separation compressor while maximizing the energy efficiency of the process.

BRIEF DESCRIPTION OF THE FIGURES

FIG. 1 describes a layout of the process in accordance with the invention, in which the stripper C-1 is supplied with the bottom fraction from a medium pressure cold separator drum B-4, and the lightest fraction obtained after separating the effluent obtained from the reaction section R-1 in succession in the high pressure drum B-1, then the medium pressure drum B-3, then the low pressure drum B-5.

The bottom fractions from the drum B-5 and from the stripper C-1 are supplied to the principal fractionation column C-2.

Figure 2:
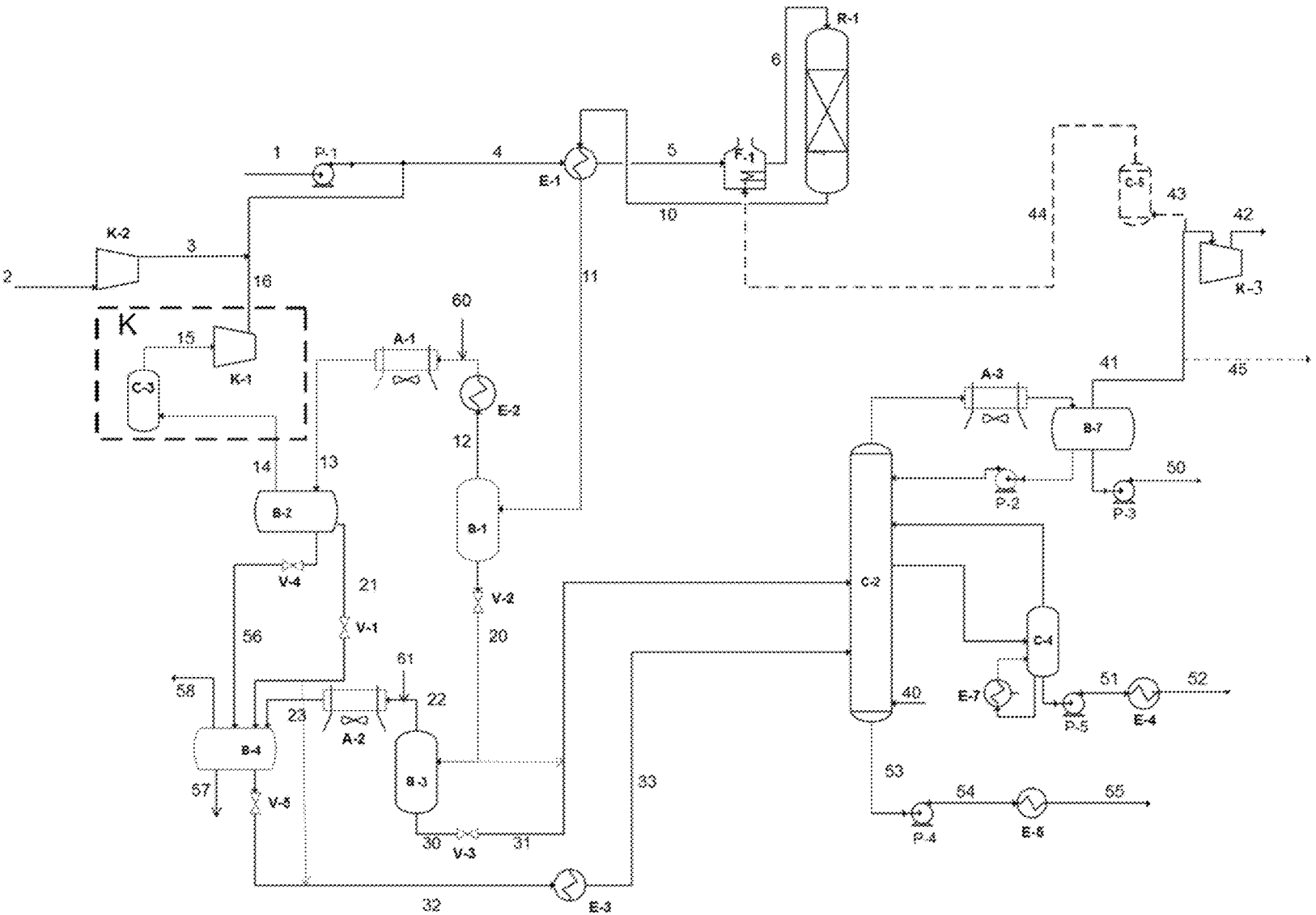

FIG. 2 describes a layout of the process in accordance with the prior art, in which there is neither a drum B-5 nor a stripper C-1. The effluent obtained from the reaction section R-1 is sent in succession to the high pressure drum B-1, then the medium pressure drum B-3, then directly to the principal fractionation column C-2 with the bottom fraction obtained from drum B-4.

BRIEF DESCRIPTION OF THE INVENTION

The present invention describes a facility for the hydrotreatment or hydroconversion of gas oils, vacuum distillates, atmospheric or vacuum residues or of an effluent from a Fischer-Tropsch unit, comprising at least:

- a reaction section R-1,
- a high pressure hot separator drum B-1, supplied with the effluent obtained from the reaction section R-1 and from which the bottom stream is supplied to the separator drum B-5,
- a high pressure cold separator drum B-2, supplied with the overhead stream leaving the high pressure hot separator drum B-1 and from which the bottom stream is supplied to the stripper C-1,
- a compression zone K for the gaseous effluent obtained from B-2, termed the recycled hydrogen,
- a low pressure hot separator drum B-5, supplied with the liquid stream obtained from B-1, and from which the overhead gaseous effluent constitutes a portion of the feed for the stripper C-1, and from which the liquid effluent constitutes the first portion of the feed for the fractionation column C-2,
- a separation column C-1 (also termed a stripper) supplied with the liquid stream obtained from B-2, and the gaseous stream obtained from B-5, from which the bottom product constitutes the other portion of the feed for the fractionation column C-2,
- a principal fractionation column C-2, supplied with the bottom product from the stripper C-1 and with the liquid stream obtained from the bottom of B-5, and which separates the following cuts: naphtha (light and heavy), diesel, kerosene and residue,
- a furnace F-1 heating the feed for the reaction section R-1 and/or a portion of the hydrogen necessary for said reaction section.

In a variation of the facility in accordance with the present invention, the facility further comprises:

- a medium pressure hot separator drum B-3, supplied with the liquid stream obtained from B-1, and from which the liquid effluent is supplied to the drum B-5,
- a medium pressure cold separator drum B-4, supplied with the liquid stream obtained from B-2 and the gaseous stream obtained from B-3, and from which the liquid effluent constitutes a portion of the feed for the stripper C-1.

The present invention also concerns a process for the hydrotreatment or hydroconversion of gas oil, vacuum distillates, atmospheric or vacuum residues using the facility described above.

In the process in accordance with the invention, the separation column C-1 is generally operated under the following conditions: total pressure in the range 0.6 to 2.0 MPa, preferably in the range 0.7 to 1.8 MPa.

In the process in accordance with the invention, the fractionation column C-2 is generally operated under the following pressure conditions: total pressure in the range 0.1 MPa to 0.4 MPa, preferably in the range 0.1 MPa to 0.3 MPa.

In accordance with a variation of the process in accordance with the invention, at least a portion of the overhead fraction obtained from the fractionation column C-2 containing the residual acid gases is sent to a scrubbing column C-5 operated at very low pressure, in order to eliminate at least a portion of the $H_2S$, said portion of the overhead fraction then being used by way of a makeup as a fuel in the furnace F-1 for the reaction section.

In accordance with another variation of the process in accordance with the invention, at least a portion of the overhead fraction obtained from the fractionation column C-2 containing the residual acid gases is sent to the acid gas compressors of a fluidized catalytic cracking unit (FCC). Finally, in accordance with a further variation of the process of the invention, the temperature of the high pressure hot separator drum B-1 is selected in a manner such that a furnace is not required for the feed for the principal fractionation C-2.

DETAILED DESCRIPTION OF THE INVENTION

The remainder of the description provides supplemental information regarding the operating conditions of the process and the catalysts used in the reaction section.

In general, in the process using the facility in accordance with the invention, the reaction section R-1 may comprise several reactors disposed in series or in parallel.

Each reactor of the reaction section comprises at least one bed of catalyst. The catalyst may be employed in a fixed bed or an expanded bed, or in fact in an ebullated bed. In the case in which a catalyst is used in a fixed bed, it is possible to provide several beds of catalysts in at least one reactor.

Any catalyst known to the person skilled in the art may be used in the process in accordance with the invention, for example a catalyst comprising at least one element selected from elements from group VIII of the periodic classification (groups 8, 9 and 10 of the new periodic classification), and optionally at least one element selected from elements from group VIB of the periodic classification (group 6 of the new periodic classification).

The operating conditions for the hydrotreatment or hydroconversion reaction section R-1 are generally as follows:

The temperature is typically in the range from approximately 200° C. to approximately 460° C., The total pressure is typically in the range from approximately 1 MPa to approximately 20 MPa, generally in the range 2 to 20 MPa, preferably in the range 2.5 to 18 MPa, and highly preferably in the range 3 to 18 MPa, The overall hourly space velocity of liquid feed for each catalytic step is typically in the range from approximately 0.1 to approximately 12, and preferably in the range from approximately 0.4 to approximately 10 $h^{-1}$ (the hourly space velocity is defined as the volume flow rate of feed divided by the volume of catalyst), The purity of the recycled hydrogen used in the process in accordance with the invention is typically in the range 50% to 100% by volume, The quantity of recycled hydrogen with respect to the liquid feed is typically in the range from approximately 50 to approximately 2500 $Nm^3/m^3$.

In order to implement the process in accordance with the invention, it is possible to use a conventional hydroconversion catalyst comprising at least one metal or compound of a metal having a hydrodehydrogenating function on an amorphous support. This catalyst may be a catalyst comprising metals from group VIII, for example nickel and/or cobalt, usually in association with at least one metal from group VIB, for example molybdenum and/or tungsten.

As an example, it is possible to use a catalyst comprising 0.5% to 10% by weight of nickel (expressed in terms of nickel oxide, NiO) and 1% to 30% by weight of molybdenum, preferably 5% to 20% by weight of molybdenum (expressed in terms of molybdenum oxide, $MoO_3$) on an amorphous mineral support.

The total quantity of oxides of metals from groups VI and VIII in the catalyst is generally in the range 5% to 40% by weight, and preferably in the range 7% to 30% by weight. The ratio by weight (expressed on the basis of the metallic oxides) between the metal (or metals) from group VI and the metal (or metals) from group VIII is, in general, approximately 20 to approximately 1, and usually approximately 10 to approximately 2.

As an example, the support is selected from the group formed by alumina, silica, silica-aluminas, magnesia, clays and mixtures of at least two of these minerals.

This support may also include other compounds, for example oxides selected from boron oxide, zirconia, titanium oxide, and phosphoric anhydride.

Usually, an alumina support is used, preferably $\eta$ or $\gamma$ alumina.

The catalyst may also contain a promoter element such as phosphorus and/or boron. This element may have been introduced into the matrix or, as is preferable, it may have been deposited onto the support. Silicon may also be deposited on the support, alone or with the phosphorus and/or the boron.

Preferably, the catalysts contain silicon deposited on a support such as alumina, optionally with phosphorus and/or boron deposited on the support, and also containing at least one metal from group VIII (Ni, Co) and at least one metal from group VIB (Mo, W). The concentration of said element is usually less than approximately 20% by weight (based on the oxide), and normally less than approximately 10%.

The concentration of boron trioxide ($B_2O_3$) is usually approximately 0 to approximately 10% by weight.

Another catalyst is a silica-alumina comprising at least one metal from group VIII and at least one metal from group VIB.

Another type of catalyst which can be used in the process in accordance with the invention is a catalyst containing at least one matrix, at least one Y zeolite and at least one hydrodehydrogenating metal. The matrices, metals and additional elements described above may also form part of the composition of this catalyst.

Advantageous Y zeolites for use in the context of the process in accordance with the invention are described in patent applications WO 00/71641, EP 0 911 077 as well as in U.S. Pat. Nos. 4,738,940 and 4,738,941.

Certain compounds with a basic nature such as basic nitrogen are well known to significantly reduce the cracking activity of acid catalysts such as silica-aluminas or zeolites. The more pronounced the acidic nature of the catalyst (silica-alumina, or even zeolite), the greater a reduction in the concentration of basic compounds by dilution will have a beneficial effect on the mild hydrocracking reaction.

The separation column (stripper) C-1 is intended to eliminate the gases obtained from cracking (generally termed acid gases), and in particular $H_2S$ obtained from reactions of the reaction section. This column C-1 may use any stripping gas such as, for example, a hydrogen-containing gas, or steam. Preferably, steam is used to carry out the stripping in accordance with the invention.

In a variation of the invention, the separation column C-1 (stripper) may be reboiled.

The pressure of this separation column C-1 is generally sufficiently high for the acid gases obtained from this separation, which have already been purified of the $H_2S$ they contain, to be able to be re-injected into the fuel gas system of the site. The total pressure is typically in the range from approximately 0.4 MPa to approximately 2.0 MPa, generally in the range 0.6 to 2.0 MPa, preferably in the range 0.7 to 1.8 MPa.

The fractionation column C-2 is preferably supplied with any stripping gas, preferably with steam. The total pressure of the fractionation column C-2 is generally in the range 0.1 MPa to 0.4 MPa, preferably in the range 0.1 MPa to 0.3 MPa.

The overhead fraction from the fractionation column C-2 contains residual acid gases which are compressed in the compressor K-3 before being sent towards the acid gas treatment section which generally uses an amine scrubbing column. After scrubbing, this fraction of acid gases is then directed towards the fuel gas system.

In accordance with this variation, at least a portion of the overhead fraction obtained from the fractionation column C-2 containing the residual acid gases is sent to a scrubbing column C-5 which is operated at very low pressure, in order to eliminate at least a portion of the $H_2S$, said portion of the overhead fraction being used, by way of a makeup, as a fuel in the furnace F-1 for the reaction section.

In accordance with a further variation of the invention, which is particularly suitable for hydrodesulphurization units with a view to constituting the feed for a catalytic cracking unit, at least a portion of the overhead fraction obtained from the fractionation column C-2 containing the residual acid gases is sent to the acid gas compressors of a fluidized catalytic cracking unit (FCC). Thus, this can be used to dispense with the acid gas compressor for the hydrodesulphurization unit.

The high pressure hot separator drum B-1 is generally operated at a slightly lower pressure, for example a pressure which is 0.1 MPa to 1.0 MPa lower than that of the reactor R-1. The temperature of the hot separator drum B-1 is generally in the range 200° C. to 450° C., preferably in the range 250° C. to 380° C., and highly preferably in the range 260° C. to 360° C.

In accordance with a preferred variation, the temperature of the high pressure hot separator drum B-1 is selected in a manner such that a furnace is not necessary for the principal fractionation feed C-2.

The high pressure cold separator drum B-2, from which the feed therefor is the gaseous stream obtained from the hot separator drum B-1, is operated at a slightly lower pressure than that for B-1, for example a pressure which is 0.1 MPa to 1.0 MPa lower than that of B-1.

The gaseous effluent obtained from B-2, termed the recycled hydrogen, is optionally scrubbed in the column C-3 then compressed in the compressor K-1.

The temperature of the high pressure cold separator drum B-2 is generally the lowest possible having regard to the cooling means available on site, so as to maximize the purity of the recycled hydrogen.

In accordance with a variation of the invention, the liquid obtained from the cold separator drum B-2 is decompressed in a valve or a turbine, and directed into a medium pressure cold separator drum B-4. The total pressure in this latter is preferably that required to recover the hydrogen included in the gaseous fraction separated in the drum in an efficient manner. This hydrogen recovery is preferably carried out in a pressure swing adsorption unit.

The pressure in the drum B-4 is generally in the range 1.0 MPa to 3.5 MPa, preferably in the range 1.5 MPa to 3.5 MPa.

In another variation of the invention, the liquid stream obtained from the high pressure hot separator drum B-1 is directed to a medium pressure hot separator drum B-3. The pressure of said separator drum B-3 is selected in a manner such as to be able to supply the medium pressure cold separator drum B-4 with the gaseous stream separated in the high pressure hot separator drum B-3.

In accordance with a preferred variation, a portion of the liquid obtained from B-3 may be re-injected into B-2 in order to promote dissolution of the light hydrocarbons therein and maximize the purity of the hydrogen of the recycled gas.

Preferably, the liquid stream obtained from the medium pressure hot separator drum B-3 is decompressed and directed towards a low pressure hot separator drum B-5. The pressure of said drum B-5 is selected so as to be sufficiently high, while the gaseous effluent obtained from B-5 can be directed towards the separation column C-1. The total pressure of the separator drum B-5 is typically in the range from approximately 0.2 MPa to approximately 2.5 MPa, generally in the range from 0.3 to 2.0 MPa, preferably in the range 0.4 to 1.8 MPa.

The invention differs from the prior art in that:

In contrast to the prior art of FIG. 2, in which there is no separation column upstream of the principal fractionation C-2, in the process in accordance with the invention, the light fraction of the effluent from reactor R-1 undergoes a separation which is aimed at eliminating these light compounds, and in particular $H_2S$. This separation is carried out by the stripper C-1. This separation upstream of the fractionation column C-2 can be used to substantially reduce the acid gases at the head of said principal fractionation column C-2, and reduces the power and size, and in some cases can even dispense with the compressor for the off-gas.

The lightest fraction of the effluent from the reaction zone R-1 which is stripped in the column C-1 placed upstream of the principal fractionation (column C-2) is eliminated by the overhead stream from the stripper C-1 and it is only the heavy fraction of the effluent from the reactor (stream 38 at the outlet from the drum B-5, and bottom stream from stripper C-1) which is directed, after successive optional decompressions, towards the principal fractionation C-2.

The temperature at the hot separator drum(s) is selected in a manner such as to supply the fractionation column C-2 with the heat required to obtain the fractionated products 50, 52 and 55. In accordance with the invention, the temperature of the high pressure hot drum B-1 may be selected in a manner such that there is no need for a furnace on the feed from the principal fractionation.

In addition, fractionation of the heavy effluent from the reaction section R-1 is carried out in an integrated manner in the separation column C-2 at the lowest pressure. Since separation by distillation is easier to carry out at low pressure, the energy efficiency of the process will be improved, in particular thanks to a reduction in the energy losses in the air condensers at the head of the columns.

DESCRIPTION OF AN EMBODIMENT OF THE INVENTION

The description below is made with the aid of FIG. 1, which describes one of the possible embodiments of the process in accordance with the invention. The reaction zone R-1 is a hydrocracking zone; this does not, however, constitute a limitation to the present invention which pertains to a facility with a separator drum (B-5) and stripper (C-1) assembly upstream of the principal fractionation column C-2.

The feed was a cut having boiling points in the range 350° C. to 530° C., with a mixture of 70% by weight of heavy vacuum distillate and 30% by weight of heavy gas oil from coking, having the following characteristics:

| | | |
|---|---|---|
| Specific density | | 0.965 |
| Sulphur content | % by weight | 2.8 |
| Nitrogen content | ppm by weight | 5000 |

The feed was supplied via the line 1 by the pump P-1. The makeup hydrogen, preferably in excess with respect to the feed, was supplied via the line 2 and the compressor K-2 then the line 3, and mixed with the feed 1 before being admitted into a feed-effluent exchanger (E-1) via the line 4.

The exchanger E-1 was used in order to preheat the feed using the effluent from the hydrocracking reactor R-1. After this exchange, the feed was supplied to a furnace F-1 via the line 5 so that it could reach the temperature necessary for the hydrocracking reaction, then the hot feed was sent, via the line 6, to the hydroconversion section constituted by at least one hydrocracking reactor R-1 comprising at least one hydrocracking catalyst.

The reaction section R-1 was composed of 2 reactors in series, each with 3 beds of catalyst. The first bed of the first reactor was composed of Axens HMC 868, HF858 and HR844 catalysts. The other beds were constituted by Axens HR844 catalyst.

The beds were operated at approximately 12.5 MPa and at temperatures in the range 350° C. to 370° C. The consumption of hydrogen in the reaction section was 2% with respect to the fresh feed.

The effluent from the reaction section was then sent to the exchanger E-1 via the line 10 then to the high pressure hot separator drum B-1 via the line 11. A gaseous overhead fraction was separated in this drum and recovered via the line 12.

The liquid fraction was recovered from the bottom of the drum B-1 via the line 20. Said gaseous fraction (12) comprised unreacted hydrogen, the $H_2S$ formed during the reaction as well as light hydrocarbons obtained from the conversion of hydrocarbons in the feed in the hydrocracking reaction section R-1.

After cooling in an exchanger E-2 and an air condenser A-1, this fraction was supplied, via the line 13, to a high pressure cold separator drum B-2 in order to carry out both a gas-liquid separation and to decant the aqueous liquid phase. After decompression in the valve or liquid turbine V-1, the liquid hydrocarbon phase was directed to a medium pressure cold separator drum B-4 via the line 21.

After decompression in the valve or the liquid turbine V-2, the liquid effluent obtained from the drum B-1 was directed to a medium pressure hot separator drum B-3 via the line 20. A gaseous fraction was separated out in this drum and recovered via the line 22. The gaseous fraction comprised unreacted hydrogen, $H_2S$ as well as, in general, light hydrocarbons obtained from the conversion of hydrocarbons of the feed in the reaction section R-1.

After cooling in an air condenser A-2, this fraction was supplied to the medium pressure cold separator drum B-4 via the line 23. A liquid fraction was recovered from the bottom, decompressed in the valve or liquid turbine V-3 and directed to the low pressure separator drum B-5 via the lines 30 and 31.

The gaseous fraction obtained from the high pressure cold separator drum B-2 was sent via the line 14 to an amines absorber or a scrubbing column C-3 in order to eliminate at least a portion of the $H_2S$. The gaseous fraction containing hydrogen was then recycled to the hydrocracking reactor via the lines 15 and 16, after compression using the compressor K-1 and mixing with the feed 1.

The liquid hydrocarbon effluent obtained from the drum B-4 was supplied to the stripper C-1 via the lines 32 and 33, the valve or liquid turbine V-5 and the exchanger E-3.

In accordance with a preferred variation, steam was preferably added to the overhead effluent from the drums B-1 and/or B-3 via the lines 60 and 61 in order to facilitate fractionation. This water was separated in the drums B-2 and B-4 and evacuated via the line 57 after separation. The water separated in the drum B-2 was sent to the drum B-4 via the line 56 and the valve V-4. The line 58 could be used to evacuate a gaseous stream.

The stripper C-1 was operated at 0.9 MPa at the head of the column, 45° C. at the reflux drum B-6 and at a bottom temperature of 180° C.

A gaseous fraction was separated in the drum B-5. This gaseous fraction was supplied to the stripper C-1 via the line 34. The stripper C-1 was supplied with stripping steam via the line 35 in a ratio of 7 kg/h of steam per 1 standard $m^3$ of column bottom product. Overhead from the stripper, a gaseous fraction (generally known as the acid gas) was recovered via the line 36 and a naphtha with a final boiling point usually of more than 100° C. was recovered via the line 37 by means of a drum B-6 and an exchanger E-6. The liquid recovered from the bottom of the stripper via the line 39 was sent to the principal fractionation column C-2 without the necessity for reheating in a furnace or an exchanger.

The liquid fraction obtained from the drum B-5 was supplied directly to the principal fractionation C-2 via the line 38 without requiring an operation for separating the acid gases in a stripping column or a reboiling separation column.

The principal fractionation column C-2 was operated at a low pressure of 0.29 MPa at the column head, 45° C. at the reflux drum B-7 (after passing through an air condenser A-3 and a pump P-2) for a bottom temperature of 330° C. The heat necessary for separation was preferably supplied by the temperature of the hot separator drum B-5, operated at 340° C. and at 1.1 MPa. This column C-2 was also supplied with stripper steam via the line 40 in a ratio of 7 kg/h of steam per 1 standard $m^3$ of column bottom product.

The overhead fraction recovered via the line 41 contained residual acid gases which were compressed in the compressor K-3 before exporting to the acid gas treatment (generally an amine scrubber or a scrubbing column) before being directed to a fuel gas system via the line 42.

In accordance with a variation of the invention, the residual acid gases were sent via the line 43 to an amines absorber or a scrubbing column C-5 operating at very low pressure, which could eliminate at least a portion of the $H_2S$ before being used to a minor extent as a fuel in the furnace R-1 of the reaction section via the line 44.

In accordance with another variation of the invention, which was particularly suitable for hydrodesulphurization units with a view to constituting the feed for a catalytic cracking unit, these residual acid gases were directed towards the acid gas compressors of the fluid catalytic cracking unit via the line 45.

The product obtained from line 50 via the pump P-3 was constituted by naphtha cuts with a final boiling point which was usually less than 200° C.

The intermediate fraction obtained from the principal fractionation column C-2 via the intermediate column C-4 (optional), optionally equipped with a reboiler E-7, via the line 51 was cooled, for example, by means of an exchanger E-4 after passing through a pump P-5, then recovered via the line 52. It was, for example, a gas oil cut with a 95% by volume distillation temperature (NF EN ISO standard 3405) of less than 360° C.

The heavy fraction obtained via the lines 53 and 54 from the principal fractionation column was also cooled after passing through a pump P-4 by means of the exchanger E-5. The fraction obtained thereby via the line 55 was a vacuum gas oil with cut points close to those of the initial feed.

In accordance with another embodiment, it was possible to recover a fraction ranging from naphtha to light gas oil via the line 50, and a complementary heavy gas oil fraction via the line 55. In this case, the fractionation column C-2 did not comprise intermediate fractionation at C-4 and the lines 51 and 52 were absent.

Figure 1:
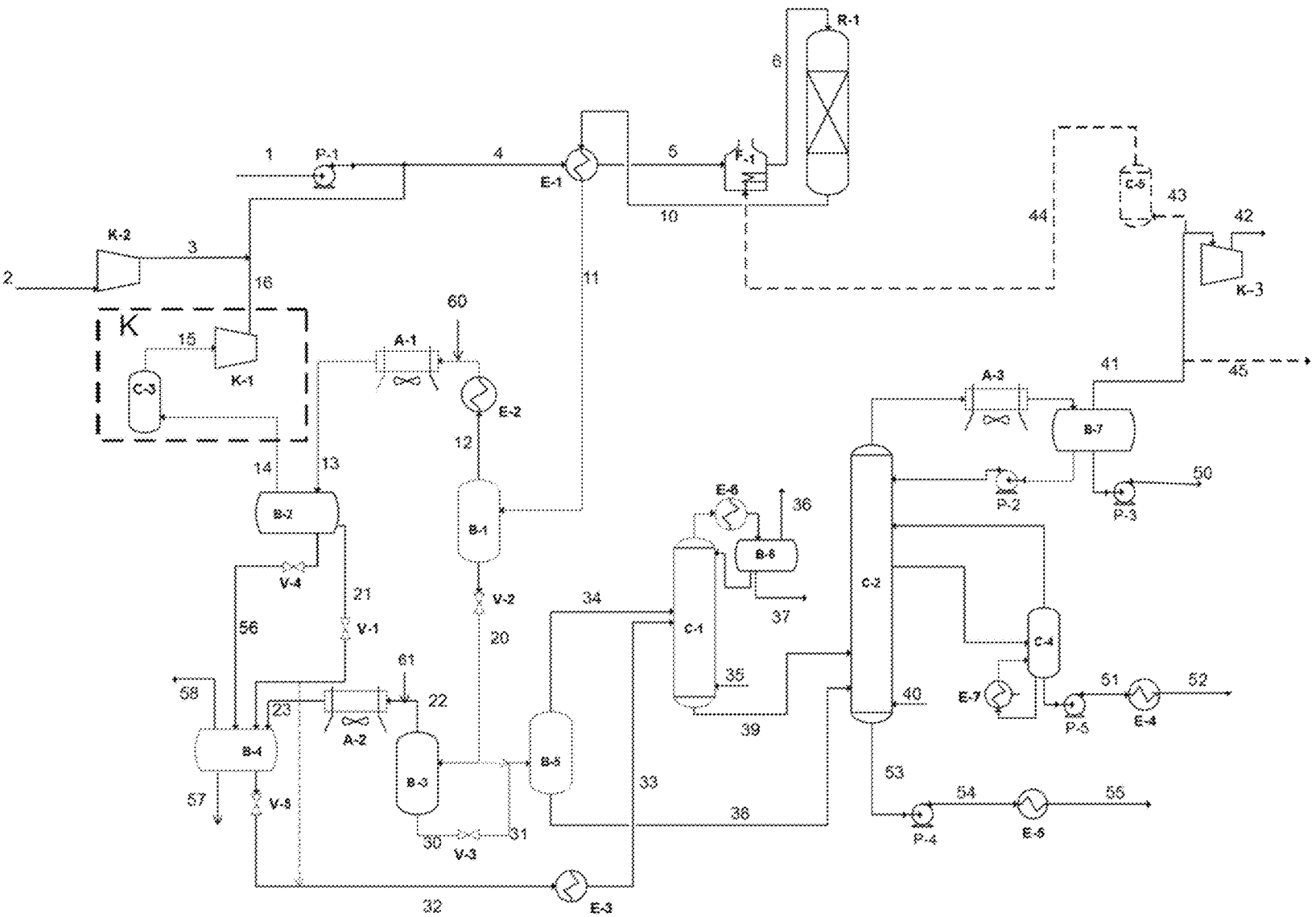
FIGS. 1 and 2 have the same numbering for the same equipment of the facility.

In accordance with another implementation of the fractionation column C-2, it was possible to withdraw a kerosene cut and a diesel cut as side streams (not shown in FIG. 1).

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French application No. 15/63.173, filed Dec. 23, 2015, are incorporated by reference herein.

Example

Table 1 compares a mild hydrocracking process in accordance with the prior art, i.e. without a stripper C-1 (FIG. 2), with a mild hydrocracking process in accordance with the invention, i.e. with the drum B-5 and stripper C-1 (FIG. 1).

TABLE 1

| | Prior art (FIG. 2) | In accordance with the invention (FIG. 1) | | |
|---|---|---|---|---|
| Mass flow rate (kg/h) | Overhead gas, principal fraction-ation (41) | Overhead gas, stripper (36) | Overhead gas, principal fraction-ation (41) | Total of acid gases (36) + (41) |
| $H_2$ | 28 | 23 | 6 | 29 |
| $H_2S$ | 125 | 99 | 26 | 125 |

TABLE 1-continued

| | Prior art (FIG. 2) | In accordance with the invention (FIG. 1) | | |
|---|---|---|---|---|
| Mass flow rate (kg/h) | Overhead gas, principal fraction-ation (41) | Overhead gas, stripper (36) | Overhead gas, principal fraction-ation (41) | Total of acid gases (36) + (41) |
| $NH_3$ | 9 | 4 | 3 | 7 |
| Methane | 51 | 41 | 11 | 52 |
| Ethane | 91 | 77 | 14 | 91 |
| Propane | 132 | 100 | 20 | 120 |
| Isobutane | 68 | 41 | 11 | 52 |
| Normal butane | 104 | 55 | 15 | 70 |
| TOTAL | 608 | 440 | 107 | 547 |

In the process in accordance with the invention, the quantity of acid gas overhead from the low pressure principal fractionation column (stream 41), which had to be compressed in the compressor K-3, was divided by 6 compared with the process in accordance with the prior art (107 kg/h as opposed to 608 kg/h).

In the case of a mild hydrocracking in accordance with the prior art (in accordance with FIG. 2), the entirety of the bottom fraction from the medium pressure hot separator drum B-3 and the bottom fraction from the medium pressure cold drum B-4 was supplied to the fractionation column C-2.

In the process in accordance with the invention (FIG. 1), the temperature of the low pressure hot separator drum B-5 was 340° C., which meant that a furnace for heating the feed 38 withdrawn from the bottom of the low pressure drum B-5 and supplied to the column C-2 could be dispensed with.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A facility capable of hydrotreatment or hydroconversion of gas oils, vacuum distillates, atmospheric or vacuum residues or of an effluent from a Fischer-Tropsch unit, comprising at least:

a reaction section R-1, a high pressure hot separator drum B-1, supplied with effluent obtained from the reaction section R-1 and from which a bottom stream is supplied to separator drum B-5, a high pressure cold separator drum B-2, supplied with an overhead stream leaving the high pressure hot separator drum B-1 and from which a liquid bottom stream is supplied to stripper C-1, a compression zone K supplied with gaseous effluent obtained from B-2, termed recycled hydrogen, a low pressure hot separator drum B-5, supplied with a liquid stream obtained from B-1, operating at a pressure of 0.3 to 2.0 MPa, and from which an overhead gaseous effluent constitutes a portion of the feed for the stripper C-1, and from which a liquid effluent constitutes a first portion of feed for fractionation column C-2 without separation of acid gases, a separation column C-1 also termed a stripper supplied with a liquid stream obtained from B-2, and a gaseous stream obtained from B-5, producing an acid gaseous fraction and a bottom product stripped of gases that constitutes an other portion of the feed for the fractionation column C-2, a principal fractionation column C-2, supplied with the bottom stream from the stripper C-1 and with the liquid bottom stream obtained from B-5 directly without separation of acid gases, and which separates the following cuts: naphtha, diesel, kerosene and residue, a furnace F-1 heating feed to the reaction section R-1 and/or a portion of hydrogen necessary for said reaction section R-1.

2. The facility as claimed in claim 1, further comprising:

a medium pressure hot separator drum B-3, supplied with a liquid stream obtained from B-1, and from which liquid effluent is supplied to the drum B-5, a medium pressure cold separator drum B-4, supplied with a liquid stream obtained from B-2 and a gaseous stream obtained from B-3, and from which liquid effluent constitutes a portion of the feed for the stripper C-1.

3. A process for the hydrotreatment or hydroconversion of gas oils, vacuum distillates, atmospheric or vacuum residues or effluent from a Fischer-Tropsch unit, comprising, in a facility capable of hydrotreatment or hydroconversion thereof:

reacting said gas oils, vacuum distillates, atmospheric or vacuum residues or effluent from a Fischer-Tropsch in a reaction section R-1, separating effluent from reaction section R-1 in a high pressure hot separator drum B-1, supplying a bottom stream to separator drum B-5, separating an overhead stream from high pressure hot separator drum B-1 in a high pressure cold separator drum B-2, supplying a liquid bottom stream to stripper C-1, compressing in a compression zone K gaseous effluent obtained from B-2, termed recycled hydrogen, separating a liquid stream obtained from B-1 in a low pressure hot separator drum B-5, operating at a pressure of 0.3 to 2.0 MPa, and sending an overhead gaseous effluent as a portion of feed to the stripper C-1, and sending a liquid effluent as a first portion of feed for fractionation column C-2 without separating acid gases, supplying to a separation column C-1 (also termed a stripper) a liquid stream obtained from B-2, and a gaseous stream obtained from B-5, producing an acid gaseous fraction and a bottom product stripped of gases that constitutes an other portion of the feed for the fractionation column C-2, supplying to a principal fractionation column C-2 the bottom stream from the stripper C-1 and the liquid bottom stream obtained from B-5 directly without separation of acid gases, and separating the following cuts: naphtha, diesel, kerosene and residue, heating feed to the reaction section R-1 and/or a portion of hydrogen necessary for said reaction section R-1 in a furnace F-1, in which the separation column C-1 is operated under the following conditions: total pressure in the range 0.6 to 2.0 MPa.

4. The process for the hydrotreatment or hydroconversion of gas oils, vacuum distillates, atmospheric or vacuum residues using the facility as claimed in claim 3, in which the fractionation column C-2 is operated under the following pressure conditions: total pressure in the range 0.1 MPa to 0.4 MPa.

5. The process for the hydrotreatment or hydroconversion of gas oils, vacuum distillates, atmospheric or vacuum residues as claimed in claim 3, in which at least a portion of an overhead fraction obtained from the fractionation column C-2 containing residual acid gases is sent to a scrubbing column C-5, in order to eliminate at least a portion of the $H_2S$, said portion of the overhead fraction then being used by way of a makeup as a fuel in the furnace F-1 for the reaction section.

6. The process for the hydrotreatment or hydroconversion of gas oils, vacuum distillates, atmospheric or vacuum residues as claimed in claim 3, in which at least a portion of an overhead fraction obtained from the fractionation column C-2 containing residual acid gases is sent to acid gas compressors of a fluid catalytic cracking unit (FCC).

7. The process for the hydrotreatment or hydroconversion of gas oils, vacuum distillates, atmospheric or vacuum residues as claimed in claim 3, in which the high pressure hot separator drum B-1 has a temperature selected in a manner such that a furnace is not required for the feed for the principal fractionation C-2.

8. A process for the hydrotreatment or hydroconversion of gas oils, vacuum distillates, atmospheric or vacuum residues using the facility as claimed in claim 3, in which the separation column C-1 is operated under the following conditions: total pressure in the range 0.7 to 1.8 MPa.

9. A process for the hydrotreatment or hydroconversion of gas oils, vacuum distillates, atmospheric or vacuum residues using the facility as claimed in claim 3, in which the separation column C-2 is operated under the following conditions: total pressure in the range 0.1 to 0.3 MPa.

10. The process for hydrotreatment or hydroconversion according to claim 3, wherein stripper C-1 produces a stripped bottom product after elimination of gases obtained from cracking and an acid gaseous fraction, and fractionation column C-2 produces an overhead fraction that contains residual acid gas.

11. The process for hydrotreatment or hydroconversion according to claim 3, wherein the effluent of separation column C-1 is sent directly to the principal fractionation column C-2.

* * * * *